US011614243B2

(12) United States Patent
Takahara et al.

(10) Patent No.: US 11,614,243 B2
(45) Date of Patent: Mar. 28, 2023

(54) OUTDOOR UNIT, AIR CONDITIONER, FAN GUARD, AND METHOD OF MANUFACTURING FAN GUARD

(71) Applicant: Samsung Electronics Co., Ltd., Suwon-si (KR)

(72) Inventors: Takeshi Takahara, Kanagawa (JP); Hideki Ishikawa, Kanagawa (JP); Suguru Nakagawa, Kanagawa (JP); JeiMin Choi, Suwon-si (KR); JaeSung Yoo, Suwon-si (KR); Joonho Yoon, Suwon-si (KR); DongSik Jin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 288 days.

(21) Appl. No.: 16/957,095

(22) PCT Filed: Dec. 13, 2018

(86) PCT No.: PCT/JP2018/045819
§ 371 (c)(1),
(2) Date: Jun. 22, 2020

(87) PCT Pub. No.: WO2019/124200
PCT Pub. Date: Jun. 27, 2019

(65) Prior Publication Data

US 2020/0348032 A1 Nov. 5, 2020

(30) Foreign Application Priority Data

Dec. 20, 2017 (JP) ..... JP2017-243669

(51) Int. Cl.
*F24F 1/56* (2011.01)
*F24F 1/50* (2011.01)
*F24F 13/20* (2006.01)

(52) U.S. Cl.
CPC ..... *F24F 1/56* (2013.01); *F24F 1/50* (2013.01); *F24F 13/20* (2013.01)

(58) Field of Classification Search
CPC ..... F24F 1/56; F24F 1/48; F24F 1/50; F24F 13/08; F24F 13/082; F24F 13/20
(Continued)

(56) References Cited

U.S. PATENT DOCUMENTS

| | | | | |
|---|---|---|---|---|
| 7,172,387 | B2 * | 2/2007 | Yamamoto | F24F 1/38 415/121.2 |
| 9,347,465 | B2 * | 5/2016 | González | F24F 1/06 |
| 10,228,149 | B2 | 3/2019 | Kasugai et al. | |

FOREIGN PATENT DOCUMENTS

| | | |
|---|---|---|
| JP | 62-105433 U | 7/1987 |
| JP | 11-223362 A | 8/1999 |

(Continued)

OTHER PUBLICATIONS

International Search Report dated Jan. 29, 2019 in connection with International Patent Application No. PCT/JP2018/045819, 2 pages.

*Primary Examiner* — Henry T Crenshaw
*Assistant Examiner* — Kamran Tavakoldavani

(57) ABSTRACT

The present disclosure is to reduce a blowing resistance while securing a mechanical strength of a fan guard.
An outdoor unit 100 includes a housing 10 in which an air discharge port X is formed on an upper wall 11, a blowing fan 20 disposed inside the housing 10 to correspond to the air discharge port X, and a fan guard 30 configured to cover the blowing fan 20, wherein the fan guard 30 includes a plurality of annular ribs 32 disposed to be spaced apart from each other in a radial direction of the blowing fan 20, and radial ribs 33 configured to connect a plurality of the annular ribs 32, and wherein the radial ribs 33 are formed such that free ends 3*a* thereof are bent in the same direction in a cross section orthogonal to a stretching direction and a pair of
(Continued)

opposing piece portions 3*b* including each of the free ends 3*a* are in surface contact with each other.

15 Claims, 8 Drawing Sheets

(58) Field of Classification Search
USPC ..... 454/275
See application file for complete search history.

(56) References Cited

FOREIGN PATENT DOCUMENTS

| | | | |
|---|---|---|---|
| JP | 2003-214658 | A | 7/2003 |
| JP | 2009-14325 | A | 1/2009 |
| JP | 2011-85356 | A | 4/2011 |
| JP | 2011-85358 | A | 4/2011 |
| JP | 2016-130616 | A | 7/2016 |
| JP | 2017-215079 | A | 12/2017 |
| KR | 10-2016-0077835 | A | 7/2016 |
| KR | 10-2017-0051276 | A | 5/2017 |

* cited by examiner

OUTDOOR UNIT, AIR CONDITIONER, FAN GUARD, AND METHOD OF MANUFACTURING FAN GUARD

CROSS-REFERENCE TO RELATED APPLICATIONS

This application is a 371 of International Application No. PCT/JP2018/045819 filed on Dec. 13, 2018, which claims priority to Japanese Patent Application No. 2017-243669 filed on Dec. 20, 2017, the disclosures of which are herein incorporated by reference in their entirety.

BACKGROUND

1. Field

The present disclosure relates to an upward type outdoor unit, an air conditioner including the outdoor unit, a fan guard commonly used in the outdoor unit, and a method of manufacturing the fan guard.

2. Description of Related Art

An upward type outdoor unit includes a housing having an air discharge port on an upper wall, a blowing fan installed inside the housing to correspond to the air discharge port, and a fan guard covering the blowing fan, as shown in Patent Document 1.

The fan guard includes a plurality of annular ribs spaced apart from each other in a radial direction of the blowing fan, and radial ribs connecting the annular ribs.

In the case of the upward type outdoor unit, in order to prepare for the possibility of an object falling from an upper side, a mechanical strength required for the fan guard is higher than that of a horizontal type outdoor unit, so that a rib thickness tends to be thick.

A large upward type outdoor unit may be installed on a roof of a building, for example, and because of a large air flow rate of the large upward type outdoor unit, especially when the radial ribs that hinder swirling flow of the blowing fan are thick, the radial ribs act as a blowing resistance, resulting in a decrease in blowing efficiency.

The present disclosure is to solve the above-mentioned problems, and the main task is to reduce a blowing resistance while securing a mechanical strength of a fan guard.

SUMMARY

One aspect of the present disclosure provides an outdoor unit including a housing in which an air discharge port is formed on an upper wall, a blowing fan disposed inside the housing to correspond to the air discharge port, and a fan guard configured to cover the blowing fan, wherein the fan guard includes a plurality of annular ribs disposed to be spaced apart from each other in a radial direction of the blowing fan, and radial ribs configured to connect a plurality of the annular ribs, and wherein the radial ribs are formed such that free ends thereof are bent in the same direction in a cross section orthogonal to a stretching direction and a pair of opposing piece portions including each of the free ends are in surface contact with each other.

A mechanical strength may be improved by the outdoor unit configured as described above because the free ends of the respective ribs are bent in the same direction, and a width of the radial ribs may be reduced as much as possible to reduce a blowing resistance because the pair of opposing piece portions are in surface contact with each other.

When the free ends are in surface contact with each other in a misaligned state, a portion (area) where the wind blown from the blowing fan touches becomes large, and the portion becomes a noise source to generate noise.

Therefore, it is appropriate that the free ends are in surface contact with each other.

By the above configuration, the portion where the wind blown from the blowing fan touches may become small to reduce noise.

It is appropriate that an inner circumferential portion forming the air discharge port on the upper wall is bent in the same direction as the annular rib.

By the above configuration, because the inner circumferential portion of the intersection portion between the radial rib and the upper wall may be integrally formed, the mechanical strength of the intersection portion may be improved.

When the free ends direct upward, rainwater may be collected in a gap between the free ends to corrode the ribs, and thus it is appropriate that the free ends direct downward in order to prevent this.

In order to reduce the blowing resistance while ensuring the mechanical strength of the annular ribs as well as the radial ribs, it is appropriate that the free ends are bent in the same direction and the pair of opposing pieces including each of the free ends are in surface contact with each other when viewed in the cross section orthogonal to the stretching direction.

In order to be able to easily manufacture the respective ribs, it is appropriate that a width of the annular rib and a width of the radial rib are the same.

When viewed from the cross section orthogonal to the stretching direction of the respective ribs, the mechanical strength may not be secured when the widths of the respective ribs are too small, and the respective ribs may not be bent when the widths of the respective ribs are too large. Also, when viewed from the same cross sections, the pair of opposing pieces are opened to generate the blowing resistance when heights of the respective ribs are too large.

Therefore, in order to solve the above problems, it is appropriate that the annular rib and the radial rib are formed such that a ratio of a width W and a height H is $0.1<$the width W/the height $H<0.5$ when viewed in the cross section orthogonal to the stretching direction.

As a more specific embodiment, the width W is 1 mm or more and 3.2 mm or less, and the height H is 2.5 mm or more and 7.5 mm or less, for example.

In order to further improve the mechanical strength of the fan guard, it is appropriate that the fan guard further includes a protection plate of a plate shape to which the respective radial ribs are connected and which is positioned above a shaft of the blowing fan, and is provided with a reinforcement portion protruding upward from the protection plate.

In order not to lose an outer shape of the outdoor unit, it is appropriate that the annular ribs and the radial ribs do not protrude above the protection plate.

It is appropriate that the annular ribs and the radial ribs are integrally formed with the upper wall.

In the case of the above configuration, the number of parts may be reduced, thereby reducing cost and facilitating assembly.

An air conditioner having the outdoor unit described above is also one of the present disclosure, and the air conditioner may exert the above-described effects.

Another aspect of the present disclosure provides a fan guard used in an outdoor unit including a housing in which an air discharge port is formed on an upper wall, and a blowing fan disposed inside the housing to correspond to the air discharge port, wherein the fan guard includes a plurality of annular ribs disposed to be spaced apart from each other in a radial direction of the blowing fan, and radial ribs configured to connect a plurality of the annular ribs, and wherein the radial ribs are formed such that free ends thereof are bent in the same direction in a cross section orthogonal to a stretching direction and a pair of opposing piece portions including each of the free ends are in surface contact with each other.

When the fan guard is used, the same effects as the outdoor unit described above may be exhibited.

Another aspect of the present disclosure provides a method of manufacturing a fan guard used in an outdoor unit including a housing in which an air discharge port is formed on an upper wall, and a blowing fan disposed inside the housing to correspond to the air discharge port, wherein the fan guard includes a plurality of annular ribs disposed to be spaced apart from each other in a radial direction of the blowing fan, and radial ribs configured to connect a plurality of the annular ribs, and wherein the method includes bending free ends of each of the radial ribs in the same direction in a cross section orthogonal to a stretching direction, and coming a pair of opposing piece portions comprising each of the free ends into surface contact with each other.

By the fan guard manufactured by the above method, the same effects as the outdoor unit described above may be exhibited.

As a more specific manufacturing method, a method in which the radial ribs are formed by a hemming process may be exemplified.

By the above configurations, a blowing resistance can be reduced while securing a mechanical strength of a fan guard.

DETAILED DESCRIPTION

Hereinafter, an embodiment of an outdoor unit according to the present invention will be described with reference to the drawings.

An outdoor unit 100 according to the present embodiment is connected to an indoor unit having at least an indoor heat exchanger by piping to constitute an air conditioner, and is, for example, an upward type outdoor unit installed on a roof of a building.

Figure 1:
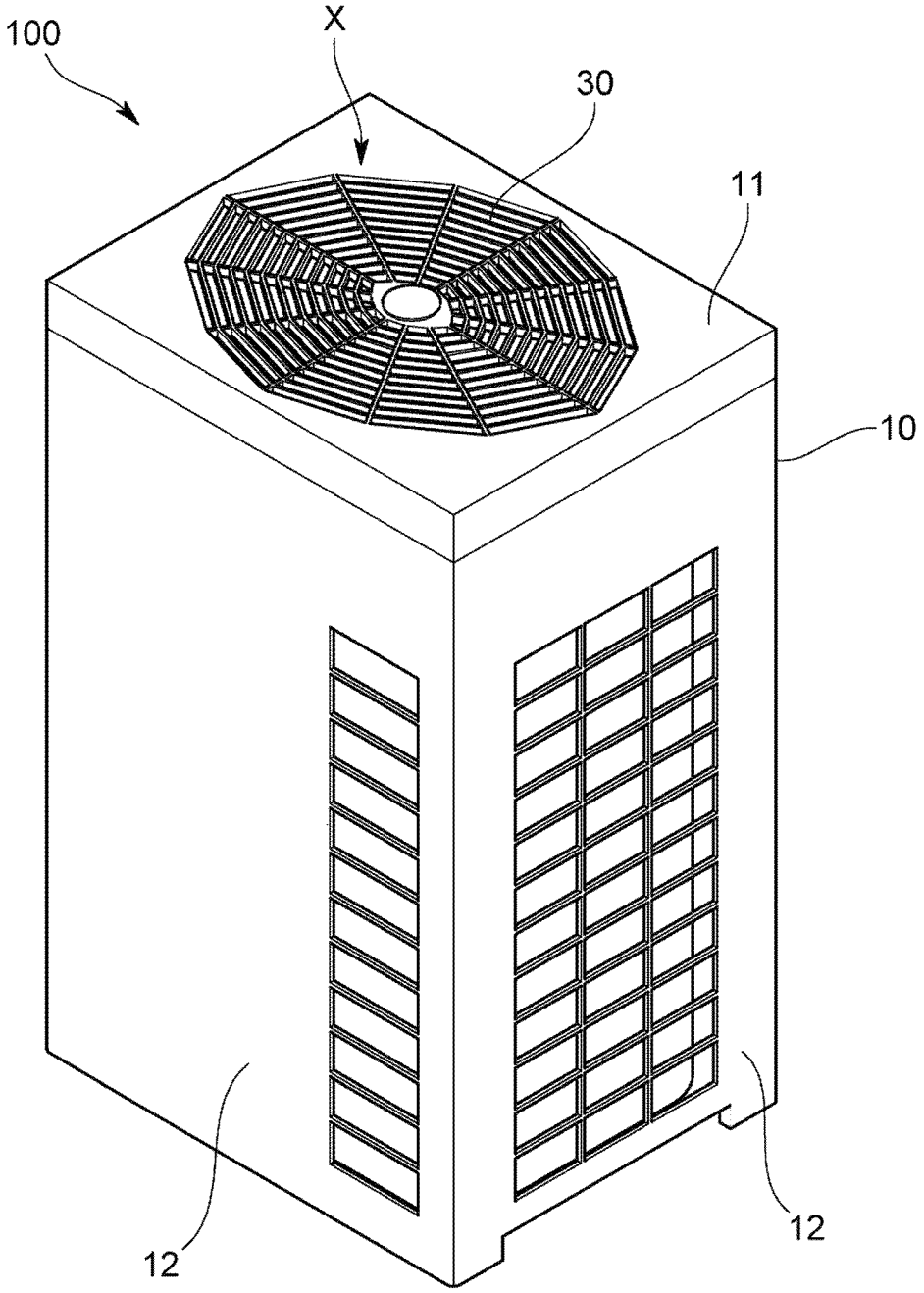
FIG. 1 is a schematic view of an outdoor unit according to an embodiment of the present disclosure.
Figure 2:
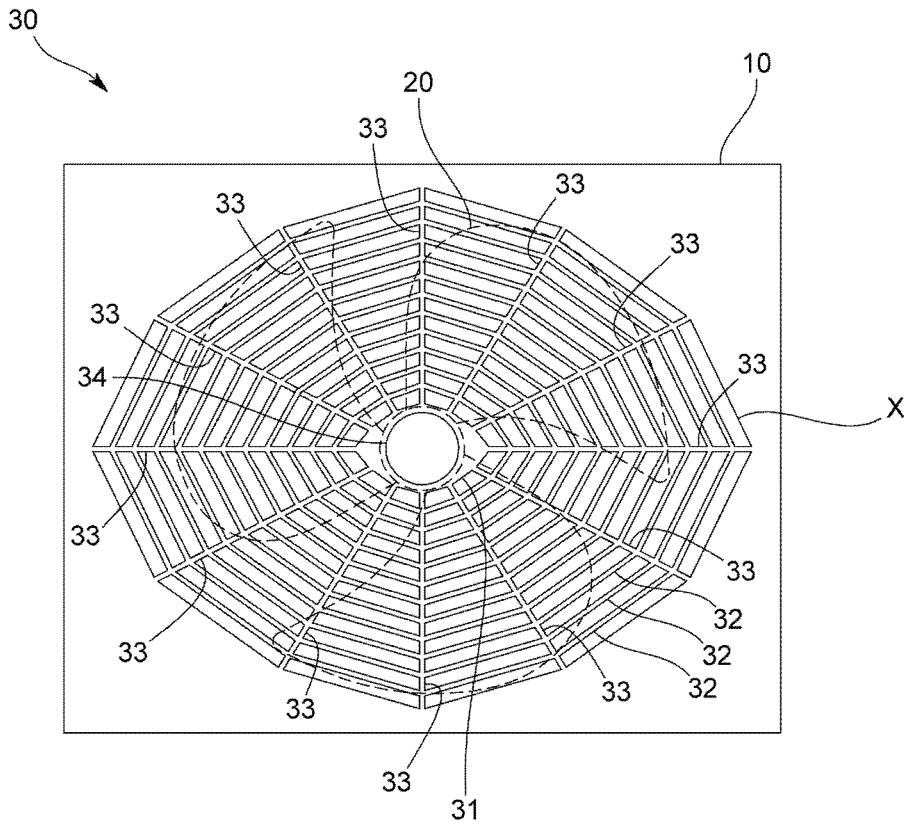
FIG. 2 is a plan view of a fan guard according to an embodiment of the present disclosure.

Specifically, as shown in FIGS. 1 and 2, the outdoor unit 100 includes a housing 10 in which an air discharge port X is formed on an upper wall 11, a blowing fan 20 disposed inside the housing 10 to correspond to the air discharge port X, and a fan guard 30 configured to cover the blowing fan 20.

The housing 10 is formed in, for example, a substantially rectangular parallelepiped shape to accommodate an outdoor heat exchanger, which is not shown, and air suction ports are formed on side walls 12. The housing 10 according to the present embodiment has one of the air discharge port X formed, but a plurality of the air discharge ports X may be formed.

The upper wall 11 of the housing 10 has a substantially rectangular shape in plan view, the air discharge port X has a large shape as much as possible to increase an air flow rate, specifically a slightly long shape along a length direction of the upper wall 11, and in the present embodiment, forms an inclined polygon. The shape of the air discharge port X may be appropriately changed such as circular, elliptical, square, rectangular, or polygonal.

The blowing fan 20 generates a swirling flow of air by receiving a control signal from a controller, which is not shown, and rotating. In the present embodiment, although one of the blowing fan 20 is provided in the housing 10, for example, two or more of the blowing fans 20 may be provided in the housing 10 by forming a plurality of the air discharge ports X.

As shown in FIG. 2, the fan guard 30 for protecting the blowing fan 20 includes a protection plate 31 positioned above a shaft of the blowing fan 20, a plurality of annular ribs 32 configured to be spaced apart from each other in a radial direction of the blowing fan 20, and radial ribs 33 configured to connect a plurality of the annular ribs 32. The annular shape referred to herein includes a circular, polygonal, or elliptical annular (ring) shape.

Figure 3:
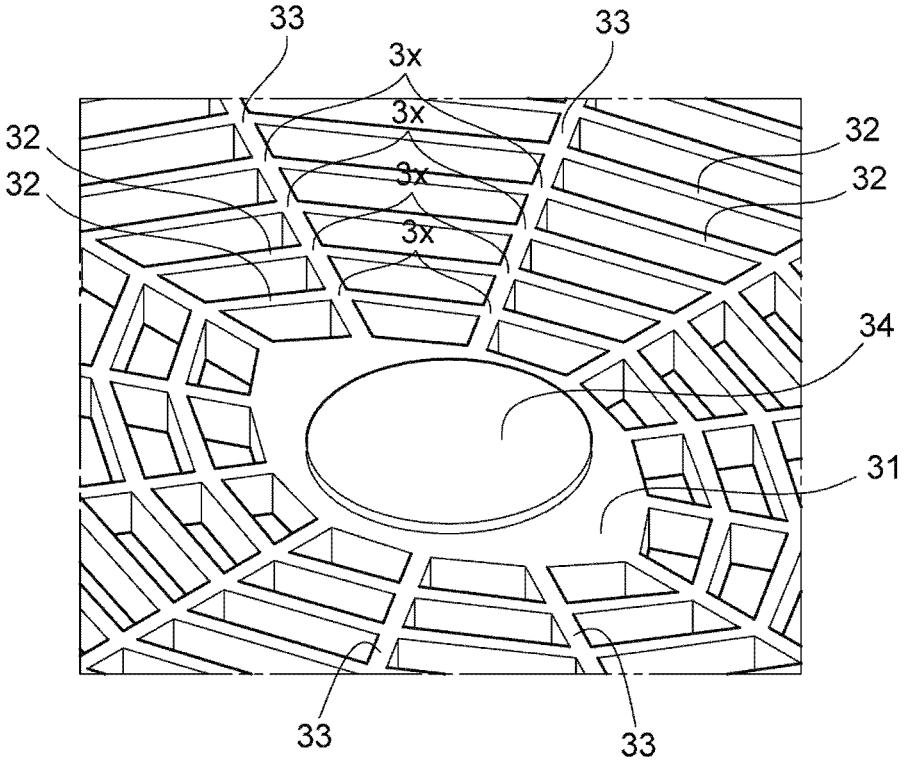
FIG. 3 is an enlarged perspective view of a protection plate of the fan guard according to an embodiment of the present disclosure.

The protection plate 31 has a flat plate shape positioned at the center of the air discharge port X, and in the present embodiment, forms a polygon like the air discharge port X. As shown in FIG. 3, the protection plate 31 according to the present embodiment is provided with a reinforcement portion 34 protruding upward to improve a mechanical strength of the protection plate 31. Although the shape of the reinforcement portion 34 may be variously changed, in the present embodiment, the reinforcement portion 34 is formed in a cylindrical shape in which a central portion of the protection plate 31 protrudes upward.

In the present embodiment, the annular rib 32 is formed in a polygonal ring shape like the air discharge port X, and is composed of a plurality of linear rib elements positioned on each side of the polygon.

The radial ribs 33 are formed in a straight shape located between an outer circumference of the protection plate 31 and an inner circumference of the air discharge port X, and in the present embodiment, and configured to extend from each vertex of the polygon of the protection plate 31 and pass through polygonal vertex portions of each of the annular ribs 32. In the present embodiment, intersection portions 3*x* between the respective radial ribs 33 and the respective annular ribs 32 are disposed at equal intervals along stretching directions of the radial ribs 33.

The fan guard 30 according to the present embodiment is provided integrally with the upper wall 11 of the housing 10, and specifically, the fan guard 30 and the upper wall 11 of the housing 10 are formed of, for example, a single member such as a sheet metal.

Figure 4:
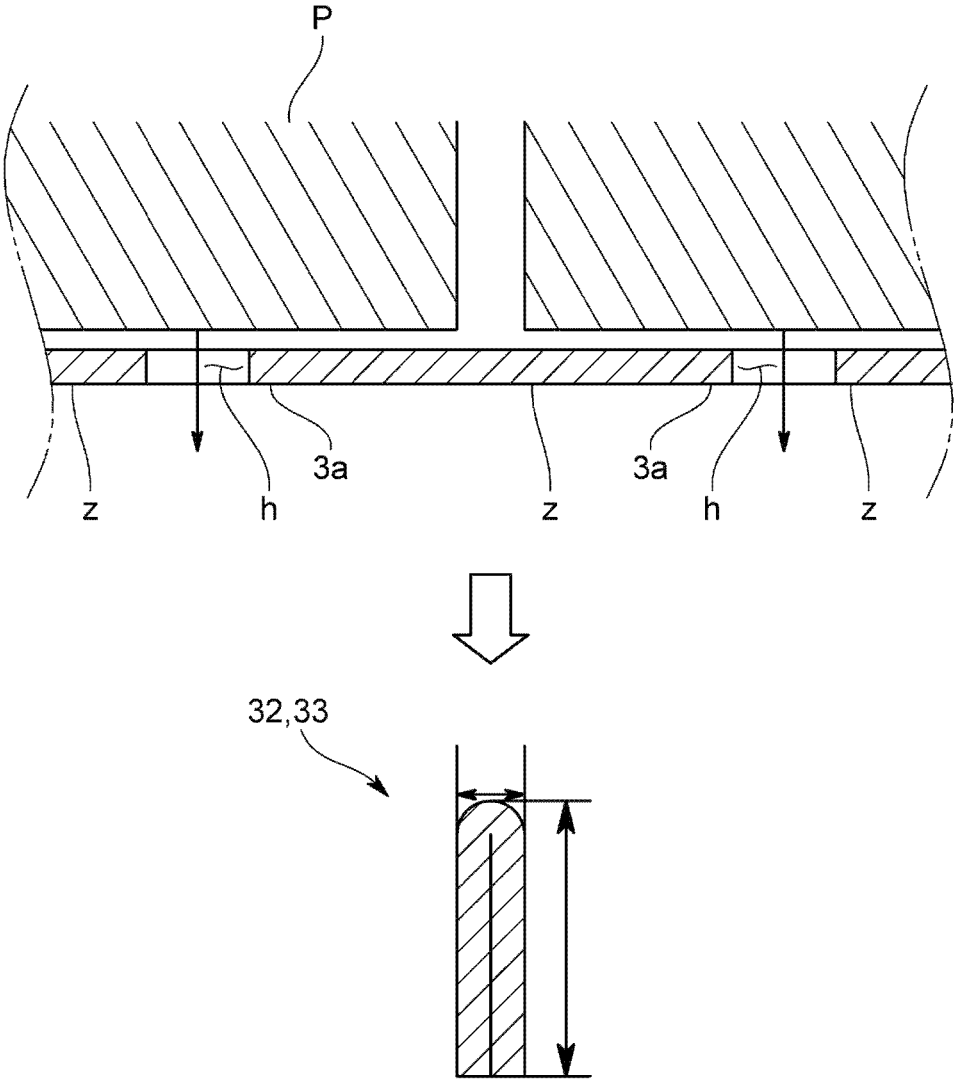
FIG. 4 is a schematic view for explaining a method of manufacturing the fan guard according to an embodiment of the present disclosure.

More specifically, as shown in FIG. 4, first, a plurality of through holes h is formed on a sheet metal or the like so that portions z in which the annular ribs 32 or the radial ribs 33 (hereinafter, also referred to as the respective ribs 32 and 33) are formed remain. Next, by bending free end portions 3*a* of the remaining portions z by pressing the sheet metal using a hemming process apparatus P in the same direction, the portions z are hemmed to form the respective ribs 32 and 33.

Figure 5:
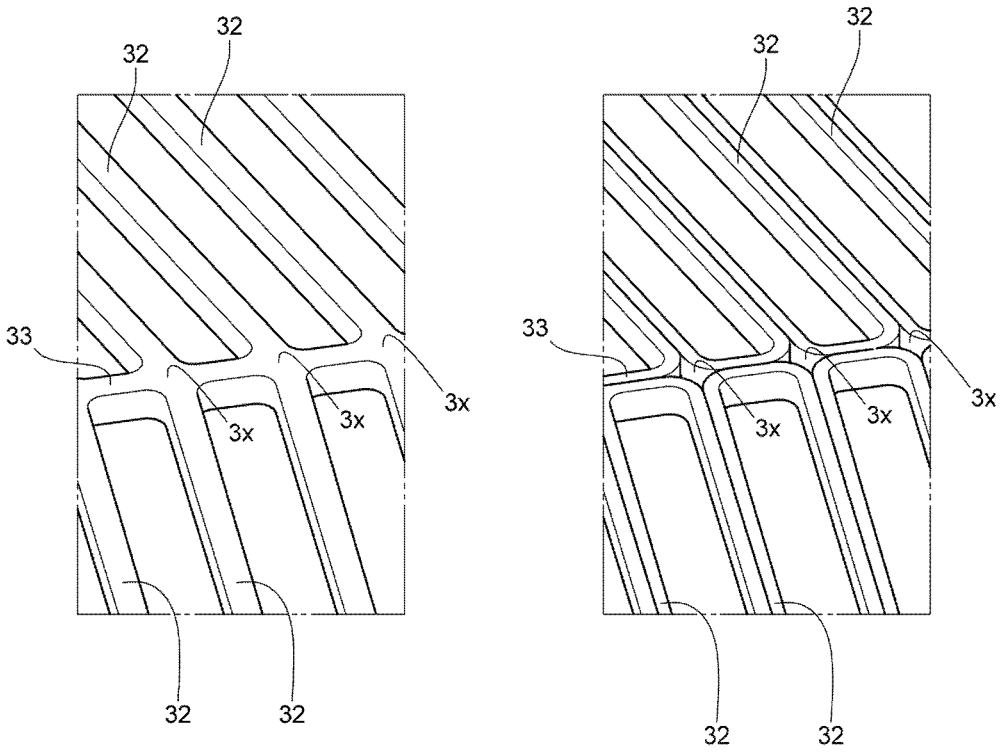
FIG. 5 is an enlarged perspective view of an intersection portion of the fan guard according to an embodiment of the present disclosure.
Figure 6:
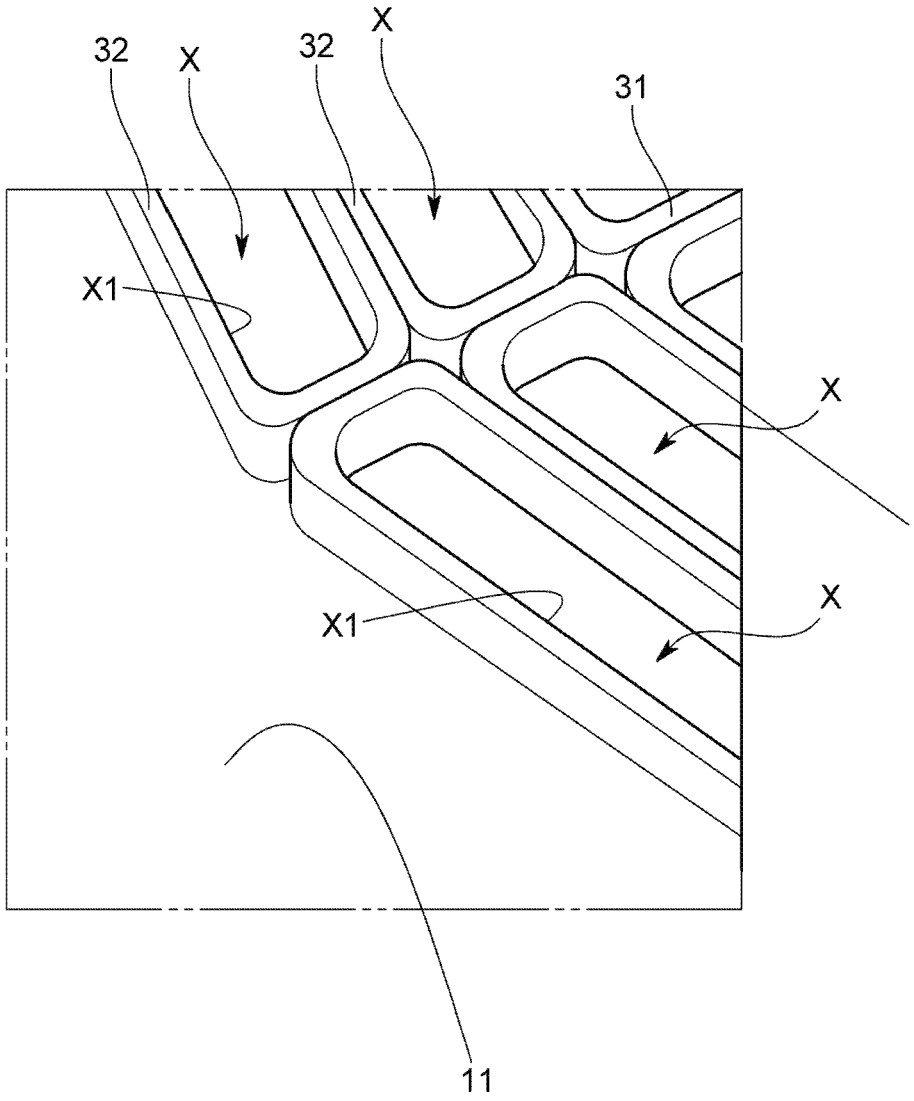
FIG. 6 is an enlarged perspective view of an inner circumferential portion of an air discharge port according to an embodiment of the present disclosure.

Due to the above-described hemming process, as shown in FIG. 5, the intersection portions 3*x* at which the annular ribs 32 and the radial ribs 33 intersect are formed such that an upper surface thereof is flat and a recess is formed on a lower surface thereof. In addition, in the present embodiment, as shown in FIG. 6, the inner circumferential portions X1 forming the air discharge ports X on the upper wall 11 are bent in the same direction as the respective ribs 32 and 33.

The respective ribs 32 and 33 do not protrude above an upper surface of the upper wall 11 or the protection plate 31, and in the present embodiment, are formed such that the upper surface of the respective ribs 32 and 33 and the upper surface of the upper wall 11 or the protection plate 31 are substantially on the same surface.

Figure 7:
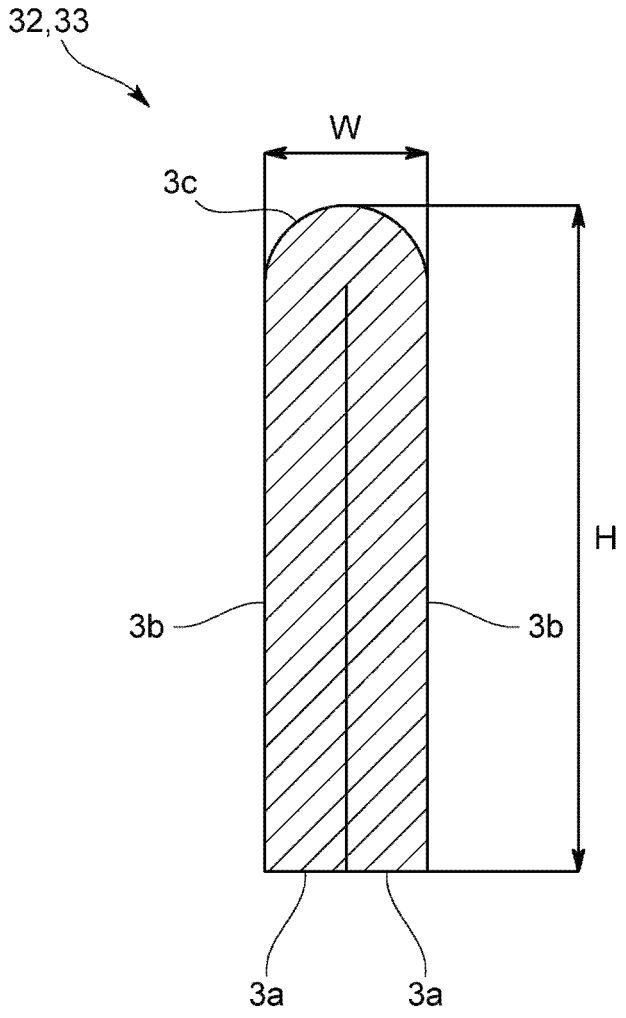
FIG. 7 is a cross-sectional view of each rib of the fan guard according to an embodiment of the present disclosure.

The respective ribs 32 and 33, as shown in FIG. 7, include a pair of opposing piece portions 3*b* including the free end 3*a*, respectively, and a bent portion connecting the opposing piece portions 3*b*, and the pair of opposing piece portions 3*b* are in surface contact with each other.

The pair of opposing piece portions 3*b* have substantially the same length, and the free ends 3*a* of the respective ribs 32 and 33 overlap each other to be in surface contact. That is, the respective ribs 32 and 33 are substantially U-shaped in a cross section orthogonal to the stretching direction.

The free ends 3*a* of the respective ribs 32 and 33 are located below the horizontality, that is, direct downward to be located below the bent portion 3*c*. In the present embodiment, the free end 3*a* directs downward in a vertical direction.

A width of the respective ribs 32 and 33 formed as described above is about twice a thickness of the sheet metal, and in the present embodiment, the respective ribs 32 and 33 have the same width and height.

When viewed from a cross section orthogonal to the stretching direction of the respective ribs 32 and 33 and when the width and height of the respective ribs 32 and 33 is W and H, respectively, the mechanical strength becomes weak when the width W is too small, and sheet metal process becomes difficult when the width W is too large. In addition, the sheet metal process becomes difficult when the height H is too small, and the opposing piece portions 3*b* are widened to increase the blowing resistance when the height H is too large.

Therefore, the respective ribs 32 and 33 according to the present embodiment are formed to satisfy 0.1<the width W/the height H<0.5, and more specifically, the respective ribs 32 and 33 are formed such that the width W is 1 mm or more and 3.2 mm or less, and the height H is 2.5 mm or more and 7.5 mm or less.

The mechanical strength may be improved by the outdoor unit 100 according to the present embodiment because the free ends 3*a* of the respective ribs 32 and 33 are bent in the same direction, and the width of the respective ribs 32 and 33 may be reduced as much as possible to reduce the blowing resistance because the pair of opposing piece portions 3*b* are in surface contact with each other.

Because the free ends 3*a* of the respective ribs 32 and 33 are in surface contact with each other, a portion where the wind blown from the blowing fan 20 touches becomes small, thereby reducing noise.

Because bottoms of the respective ribs 32 and 33 are open, rainwater may not be collected in gaps of the free ends 3*a* or in the recesses formed on the lower surfaces of the intersection portions 3*x*, so that corrosion of the respective ribs 32 and 33 may be suppressed.

Because the fan guard 30 is integrally formed with the upper wall 11 of the housing 10, the number of parts is reduced so that cost may be reduced and assembly may be facilitated.

Because the inner circumferential portions X1 forming the air discharge ports X on the upper wall 11 is bent in the same direction as the annular ribs 32 or the radial ribs 33, the inner circumferential portions X1, which are the intersection portions between the radial ribs 33 and the upper wall 22, may be integrally formed, thereby improving the mechanical strength of the intersection portions between the radial ribs 33 and the upper wall 22.

Because the widths or the heights of the respective ribs 32 and 33 are the same, the production of the respective ribs 32 and 33 may be facilitated.

Furthermore, because the reinforcement portion 34 is provided on the protection plate 31, the mechanical strength of the fan guard 30 may be further improved.

However, the present disclosure is not limited to the above embodiment.

For example, although in the above embodiment, both the annular ribs 32 and the radial ribs 33 are hemmed, considering the tendency of the radial rib 33 to act as the blowing resistance compared to the annular ribs 32, it is sufficient that at least the radial ribs 33 are hemmed. This configuration can also reduce the blowing resistance while improving the mechanical strength of the fan guard 30 compared to the prior art.

Figure 8:
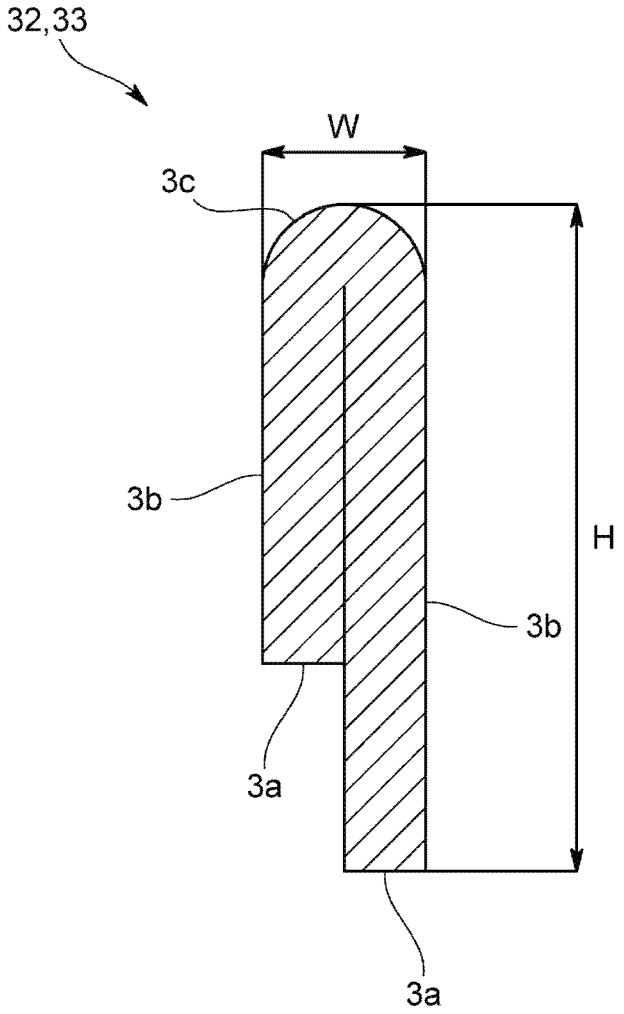
FIG. 8 is a cross-sectional view of each rib of a fan guard according to another embodiment of the present disclosure.

The respective ribs 32 and 33 according to the present embodiment are formed such that the cross section orthogonal to the stretching direction has a substantially U shape, but the cross section has a substantially J shape as shown in FIG. 8. In other words, in the above embodiment, the pair of free ends 3*a* of respective ribs 33 are in surface contact with each other, but only one of the free end 3*a* may be formed to be in surface contact with the opposing piece portion 3*b* facing each other.

In the above embodiment, both the annular ribs 32 and the radial ribs 33 have the same width and height, but the sizes of the annular ribs 32 and the radial ribs 33 may be different from each other.

In the above embodiment, the fan guard 30 and the upper wall 11 of the housing 10 are integrally formed by being formed as a single member such as a sheet metal, but the fan guard 30 may be, for example, integrally installed on the upper wall 11 by welding or the like. As such, when the fan guard 30 is integrally formed with the upper wall 11 of the housing 10, the number of parts is reduced so that cost may be reduced and assembly may be facilitated.

The respective ribs 32 and 33 and the upper surface of the upper wall 11 or the protection plate 31 need not be placed on the same surface, and for example, the respective ribs 32 and 33 may be formed to protrude above the upper surface of the upper wall 11 or the protection plate 31.

The respective ribs 32 and 33 need not necessarily be hemmed, and the manufacturing method may be variously changed.

While the present disclosure has been particularly described with reference to exemplary embodiments, it should be understood by those of skilled in the art that various changes in form and details may be made without departing from the spirit and scope of the present disclosure.

The invention claimed is:

1. An outdoor unit comprising a housing in which an air discharge port is formed on an upper wall, a blowing fan disposed inside the housing to correspond to the air discharge port, and a fan guard configured to cover the blowing fan, wherein the fan guard comprises a plurality of annular ribs disposed to be spaced apart from each other in a radial direction of the blowing fan, and radial ribs configured to connect a plurality of the annular ribs, and wherein the radial ribs are formed such that free ends thereof are bent in a same direction in a cross section orthogonal to an extending direction of the radial ribs and a pair of opposing piece portions comprising each of the free ends are in surface contact with each other.

2. The outdoor unit according to claim 1, wherein an inner circumferential portion forming the air discharge port on the upper wall is bent in a same direction as the annular ribs.

3. The outdoor unit according to claim 1, wherein the free ends are in surface contact with each other.

4. The outdoor unit according to claim 1, wherein the free ends direct downward.

5. The outdoor unit according to claim 1, wherein free ends of the annular ribs are bent in a same direction when viewed in the cross section orthogonal to the extending direction, and a pair of opposing piece portions comprising each of the free ends of the annular ribs are in surface contact with each other.

6. The outdoor unit according to claim 1, wherein the annular ribs and the radial ribs have a same width.

7. The outdoor unit according to claim 1, wherein the annular ribs and the radial ribs are formed such that a ratio of a width W and a height H is 0.1<the width W/the height H<0.5 when viewed in the cross section orthogonal to the extending direction.

8. The outdoor unit according to claim 7, wherein the width W is between 1 mm and 3.2 mm inclusive, and the height H is between 2.5 mm and 7.5 mm inclusive.

9. The outdoor unit according to claim 1, wherein the fan guard further comprises a protection plate of a plate shape to which the respective radial ribs are connected and which is positioned above a shaft of the blowing fan, and is provided with a reinforcement portion protruding upward from the protection plate.

10. The outdoor unit according to claim 9, wherein the annular ribs and the radial ribs do not protrude above the protection plate.

11. The outdoor unit according to claim 1, wherein the annular ribs and the radial ribs are integrally formed with the upper wall.

12. An air conditioner comprising the outdoor unit according to claim 1.

13. A fan guard used in an outdoor unit comprising a housing in which an air discharge port is formed on an upper wall, and a blowing fan disposed inside the housing to correspond to the air discharge port, wherein the fan guard comprises a plurality of annular ribs disposed to be spaced apart from each other in a radial direction of the blowing fan, and radial ribs configured to connect the plurality of the annular ribs, and wherein the radial ribs are formed such that free ends thereof are bent in a same direction in a cross section orthogonal to an extending direction of the radial ribs and a pair of opposing piece portions comprising each of the free ends are in surface contact with each other.

14. A method of manufacturing a fan guard used in an outdoor unit comprising a housing in which an air discharge port is formed on an upper wall, and a blowing fan disposed inside the housing to correspond to the air discharge port, wherein the fan guard comprises a plurality of annular ribs disposed to be spaced apart from each other in a radial direction of the blowing fan, and radial ribs configured to connect a plurality of the annular ribs, and wherein the method comprises:

bending free ends of each of the radial ribs in a same direction in a cross section orthogonal to an extending direction of the radial ribs; and bringing a pair of opposing piece portions comprising each of the free ends into surface contact with each other.

15. The method according to claim 14, wherein the radial ribs are formed by a hemming process.

* * * * *